US008989449B2

(12) United States Patent
Backlund et al.

(10) Patent No.: US 8,989,449 B2
(45) Date of Patent: Mar. 24, 2015

(54) METHOD AND ARRANGEMENTS FOR FIRING A FIRE ARM

(75) Inventors: Göran Backlund, Linköping (SE); Gert Johansson, Linköping (SE)

(73) Assignee: SAAB AB, Linköping (SE)

( * ) Notice: Subject to any disclaimer, the term of this patent is extended or adjusted under 35 U.S.C. 154(b) by 161 days.

(21) Appl. No.: 13/576,666

(22) PCT Filed: Feb. 2, 2010

(86) PCT No.: PCT/SE2010/050119
§ 371 (c)(1),
(2), (4) Date: Oct. 22, 2012

(87) PCT Pub. No.: WO2011/096854
PCT Pub. Date: Aug. 11, 2011

(65) Prior Publication Data
US 2013/0028486 A1 Jan. 31, 2013

(51) Int. Cl.

| | |
|---|---|
| ***G06K 9/00*** | (2006.01) |
| ***F41G 1/38*** | (2006.01) |
| ***F41G 3/12*** | (2006.01) |
| ***F41G 3/14*** | (2006.01) |
| ***F41G 3/16*** | (2006.01) |
| *G02B 23/10* | (2006.01) |

(52) U.S. Cl.
CPC .. *F41G 1/38* (2013.01); *F41G 3/12* (2013.01); *F41G 3/142* (2013.01); *F41G 3/16* (2013.01)
USPC ..... 382/107; 382/291; 356/252

(58) Field of Classification Search
CPC ..... G06K 9/00; F41G 3/165; G02B 23/10
USPC ..... 382/100, 106–107, 162, 168, 181, 199, 382/232, 254, 274, 276, 287–291, 305, 382/312; 42/111, 124; 396/420, 263; 356/252
See application file for complete search history.

(56) References Cited

U.S. PATENT DOCUMENTS

| | | | | |
|---|---|---|---|---|
| 4,309,095 | A * | 1/1982 | Buckley | 396/420 |
| 4,370,914 | A | 2/1983 | Voles | |
| 5,026,158 | A * | 6/1991 | Golubic | 356/252 |

(Continued)

FOREIGN PATENT DOCUMENTS

| | | | |
|---|---|---|---|
| DE | 102005057323 | A1 | 6/2007 |
| WO | WO-2006096183 | A2 | 9/2006 |

OTHER PUBLICATIONS

PCT/ISA/210—International Search Report—Oct. 12, 2010.

(Continued)

*Primary Examiner* — Seyed Azarian
(74) *Attorney, Agent, or Firm* — Venable LLP; Eric J. Franklin

(57) ABSTRACT

An arrangement and methods for firing a fire arm. The fire arm includes a determining unit configured to determine a movement of an aim point for the fire arm relative to a target. A processing unit is configured to determine a target point for the aim point based on the movement of the aim point relative to the target and to predict the future movement of the aim point. A firing unit is configured to fire the fire arm when the aim point is predicted to be within a tolerance of the target point.

9 Claims, 2 Drawing Sheets

(56) References Cited

U.S. PATENT DOCUMENTS

| | | | | |
|---|---|---|---|---|
| 5,392,688 | A | 2/1995 | Boutet et al. | |
| 6,871,439 | B1 | 3/2005 | Edwards | |
| 7,194,204 | B2 * | 3/2007 | Gordon | 396/263 |
| 7,404,268 | B1 | 7/2008 | Page | |
| 8,024,884 | B2 * | 9/2011 | Holmberg | 42/124 |
| 2006/0005447 | A1 * | 1/2006 | Lenner et al. | 42/111 |

OTHER PUBLICATIONS

PCT/ISA/237—Written Opinion of the International Search Authority—Oct. 12, 2010.

PCT/IPEA/409—International Preliminary Report on Patentability—Feb. 22, 2012.

* cited by examiner

METHOD AND ARRANGEMENTS FOR FIRING A FIRE ARM

CROSS-REFERENCE TO RELATED APPLICATIONS

This application is the national phase under 35 U.S.C. §371 of PCT/SE2010/050119 filed 2 Feb. 2010

TECHNICAL FIELD

The present invention relates to arrangements and methods for a fire arm, and in particular to methods and arrangements for firing a fire arm.

BACKGROUND

A firearm is a device which projects either single or multiple projectiles at high velocity through a controlled explosion. The firing is achieved by gases produced through rapid, confined burning of a propellant. There are also firearms which use electromagnetic energy to project projectiles.

Firearms are often equipped with different types of sights used to give additional accuracy using a point of aim for the fire arm. The fire arm may for instance be equipped with a telescopic sight, commonly called a scope. Other sighting systems are iron sights and laser sights.

When shooting with a fire arm the accuracy is affected from among others the stance of the shooter. Other factors that affect the accuracy of the fire arm are how the shooter is breathing, aiming and fires the fire arm. Yet other factors that affect the accuracy of the fire arm are for instance if the shooter is shaking or swaying. The accuracy is also affected from how the shooter controls the trigger. A greater accuracy is achieved if the shooter steady presses the trigger instead of slaps the trigger.

There are thus several problems in achieving accuracy when shooting with a firearm.

One solution to achieve greater accuracy when shooting with a fire arm is a system known as BORS which has been developed by the Barrett Firearms Company. The BORS module is in an electronic Bullet Drop Compensation (BDC) sensor/calculator package intended for long-range sniping. To establish the appropriate elevation for the fire arm the shooter enters the ammunition type into the BORS and the range to the target. The system automatically determines air density, as well as cant or tilt in the fire arm itself. These environmental factors are incorporates into the elevation calculations for the fire arm.

Even though the BORS system is proved useful the system does not compensate for shakings and/or sways from the shooter.

There is therefore a need for an improved solution for increasing the accuracy when shooting with a fire arm, which solution solves or at least mitigates at least one of the above mentioned problems.

SUMMARY

An object of the present invention is thus to provide arrangements and methods that increase the accuracy when shooting with a fire arm.

This object is according to the present invention achieved by providing the fire arm with determining means for determining a movement of an aim point for the fire arm relative to a target. The fire arm also comprises processing means configured to determine a target point for the aim point based on the movement of the aim point and to predict the future movement of the aim point. Firing mean in the fire arm use the target point and the predicted movement of the aim point to fire the fire arm when the aim point is predicted to be within a tolerance of the target point.

According to a first aspect the present invention relates an arrangement for firing a fire arm. The arrangement comprises determining means for determining a movement of an aim point for the fire arm relative to a target. Processing means in the arrangement are configured to determining a target point for the aim point based on the movement of the aim point and to predict a future movement of the aim point based on the movement of the aim point. The arrangement further comprises firing means configured to fire the fire arm when the aim point is predicted to be within a tolerance of the target point.

According to a second aspect the present invention relates a method in a fire arm for firing the fire arm. The method comprises the steps of: determining a movement of an aim point for the fire arm relative to a target; determining a target point for the aim point based on said movement of said aim point; predicting a future movement of the aim point based on the movement of the aim point; and firing the fire arm when the aim point is predicted to be within a tolerance of the target point.

An advantage with embodiments of the present invention is that the arrangement compensates for shakings and/or sways from for instance the shooter or a weapon platform. Thereby the arrangement among others increase the accuracy of the fire arm Yet another advantage of embodiments of the present invention is that the arrangement as a whole or in part can be mounted on an existing fire arm. It is therefore possible to apply the arrangement to a fire arm without modifying the fire arm.

BRIEF DESCRIPTION OF THE DRAWINGS

The invention will in the following be described in more detail with reference to enclosed drawings, wherein.

DETAILED DESCRIPTION

In the following description, for purposes of explanation and not limitation, specific details are set forth, such as particular sequences of steps, and device configurations in order to provide a thorough understanding of the present invention. It will be apparent to one skilled in the art that the present invention may be carried out in other embodiments that depart from these specific details.

Moreover, those skilled in the art will appreciate that functions and means explained herein below may be implemented using software functioning in conjunction with a programmed microprocessor or general purpose computer, and/or using an application specific integrated circuit (ASIC).

Figure 1A:
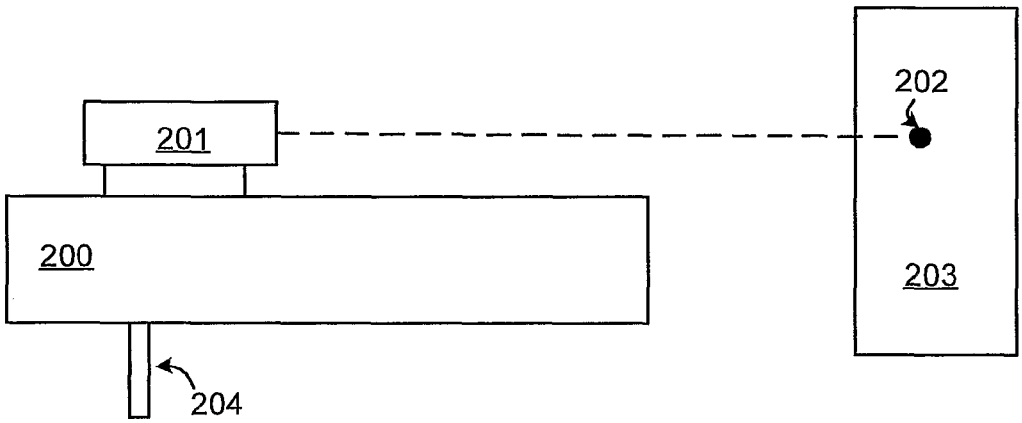
FIG. 1*a* illustrates schematically a fire arm according to prior art

FIG. 1*a* illustrates a fire arm 200 according to prior art. The fire arm 200 comprises a laser sight 201 that will project an aim point 202 on a target 203. If the shooter of the fire arm 200 for instance is shaking or swaying the aim point 202 will move on the target 203. Since this aim point 202 is moving it hard for the shooter to know when to press a trigger 204 in order to fire a shot (not shown). The accuracy when shooting with the fire arm 200 will therefore reduce as a consequence of the shakings and/or sways from the shooter.

Figure 1:
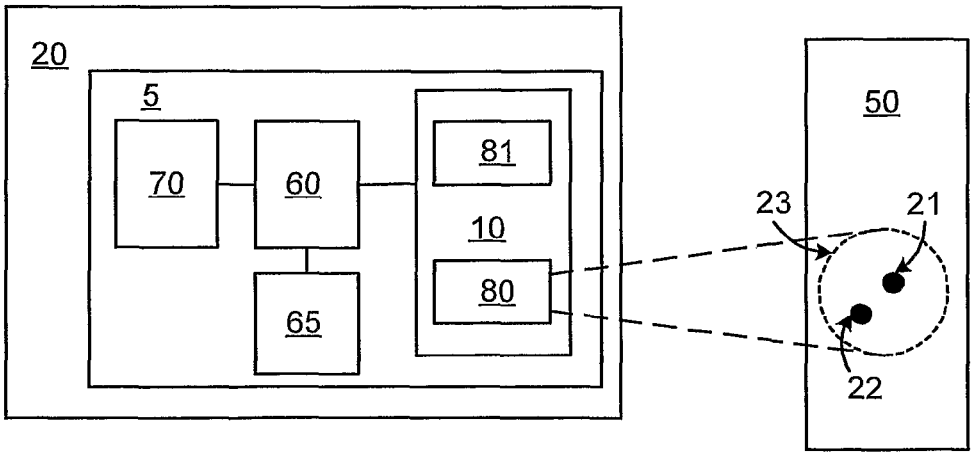
FIG. 1 illustrates schematically an arrangement for firing a fire arm according to an exemplary embodiment of the invention

FIG. 1 shows an arrangement 5 for firing a fire arm 20 according to an exemplary embodiment of the present invention. Reference number 22 denotes the aim point 22 of the fire arm 20 at the target 50. If the shooter of the fire arm 20 for instance is shaking or swaying the aim point 22 will move on the target 50. The shaking and/or swaying may for instance arise from the shooters heart beats or breathing.

In this exemplary embodiment of the arrangement 5 according to the present invention the arrangement comprises a switch 65. The switch 65 is connected to a processing means 60, which will be described further down. The switch may in an exemplary embodiment of the arrangement 5 according to the present invention be mounted on a trigger (not shown) of the fire arm 20.

In order to determine the movement of the aim point 22 relative to the target 50, the arrangement 5 according to the present invention further comprises determining means 10 for determining a movement of the aim point 22 relative to the target 50. When the switch 65 is pressed by a shooter (not shown), the determining means 10 starts to determine the movement of the aim point 22 relative to the target 50. In another exemplary embodiment of the arrangement 5 the determining means 10 continuously determines the movement of the aim point 22 relative to the target 50.

In an exemplary embodiment of the arrangement 5 according to the present invention the determining means 10 for determining the movement of the aim point 22 comprises a camera 80 which captures consecutive images of the target 50. In this exemplary embodiment the determining means 10 are further configured to determining the movement of the aim point 22 by using image processing of the consecutive images from the camera 80. The determining means 10 may for instance determine a target area 23 on the target 50. The target area 23 on the target 50 may for instance be determined using thresholding which is a well known method of image segmentation. When using thresholding the target area 23 around the aim point 22 is found by marking individual pixels around the aim point 22 as "object" pixels if their value is greater than some threshold value (assuming an object to be brighter than the background) and as "background" pixels otherwise.

Thresholding is well known image processing method and will not further be described herein. Another method that may be used to find the target area 23 around the aim point 22 is to identify significant properties of the target near the aim point 22. These significant properties may for instance be sharp gradients near the aim point 22. Yet another method that can be used by the determination means 10 to identify the target area 23 around the aim point 22 is matching of intensities in subareas in the consecutive images around the aim point 22.

When the determination means 10 has determined the target area 23 the determination means 10 can determine the movement of the aim point 22 relative to the target area 23 as a result from for instance shakings and/or sways from the shooter. The movement of the aim point 22 relative to the target 50 may be determined in many different ways. Positions of the aim point 22 relative to the target area 23 may for instance be extracted from consecutive images taken at equal intervals. These positions will then represent the movement of the aim point 23 relative to the target.

The camera 80 may in an exemplary embodiment of the arrangement 5 according to the present invention be incorporated in a telescopic sight (not shown) of the fire arm 20. In yet another exemplary embodiment of the arrangement 5 according to the present invention the camera 80 is attached to a telescopic sight of the fire arm 20. The camera 80 may also in another exemplary embodiment of the arrangement 5 according to the present invention be mounted directly on the fire arm 20. In a further exemplary embodiment of the arrangement 5 according to the present invention a digital sight may be used. In this exemplary embodiment the consecutive images can be taken directly from the digital sight.

In another exemplary embodiment of the arrangement 5 according to the present invention the determining means 10 for determining a movement of the aim point 22 relative to the target 50 comprises at least one accelerometer 81. In another exemplary embodiment of the arrangement 5 according to the present invention may the determining means 10 instead of an accelerometer 81 comprise an inertia sensor 81. In this exemplary embodiment the determining means 10 are further configured for determining the movement of the aim point 22 by using signals from the at least one accelerometer or inertia sensor 81. Using at least one accelerometer or inertia sensor 81 for determining the movement of the aim point 22, relative to the target 50, is only applicable when shooting at a target that is not moving.

The processing means 60 is further configured to determining a target point 21 for the aim point 22 based on the movement of the aim point 22. The target point 21 may be determined in many different ways from the movement of the aim point 22 relative to the target 50. If for instance the aim point 22 is moving back and forth relative to the target 50, the target point 21 may be determined to a middle point (not shown) of the back and forth movement, because this is the point that the shooter probably aims at.

The processing means 60 is further configured to predict a future movement of the aim point 22 based on the movement of the aim point 22. The future movement of the aim point 22 may be predicted in many different ways. In an exemplary embodiment of the arrangement 5 according to the present invention the processing means 60 is configured to predict a future movement of the aim point 22 based on a dynamic model of the fire arm 20. The dynamic model of the fire arm 20 may take many different factors into account related to the fire arm 20, like for instance the weight and size of the shooter or the weapon platform (not shown) the fire arm rests on, and inertia for the fire arm 20.

The dynamic model of the fire arm 20 may be a self improving dynamic model, i.e. the model is adaptive and is continuously improved by feedback from the actual aim point motion, observed from the camera images.

In another exemplary embodiment of the arrangement 5 according to the present invention the processing means 60 is further configured to wait until a movement of the target point 21 is within a tolerance before starting to predict the future movement of the aim point 22 based on the movement of the aim point 22.

The arrangement 5 according to the present invention further comprises firing means 70 configured to fire the fire arm 20 when the aim point 22 is predicted to be within a tolerance of the target point 21. Since the firing means 70 fires the fire arm when the aim point 22 is predicted to be within a tolerance of the target point 21 the accuracy of the fire arm 20 is greatly improved.

In exemplary embodiments of the arrangement 5 according to the present invention, if the switch 65 is released before the firing means 70 has fired the fire arm 20, the firing means 70 will not fire the fire arm 20.

In other exemplary embodiments of the arrangement 5 according to the present invention the switch 65 may be a switch with several positions (not shown). In a configuration of this exemplary embodiment according to the present invention, the shooter can fire the fire arm 20 by fully pressing the switch 65.

The firing means 70 may in an exemplary embodiment of the arrangement 5 according to the present invention be mounted on a trigger (not shown) of the fire arm 20. In another exemplary embodiment of the arrangement 5 may the firing means be an integrated part of the fire arm 20.

In an exemplary embodiment of the arrangement 5 according to the present invention may the arrangement 5 be configured for detachable connection to the fire arm 20.

The fire arm 20 that is used in the above exemplary embodiments of the arrangement 5 according to the present invention may be a fire arm that is hand held. The fire arm 20 may also be a larger fire arm that resides on for instance a vehicle or a weapon platform.

It should be noted that arrangement depicted in FIG. 1 may comprise other elements or means not illustrated. Furthermore, the different blocks of the arrangement 5 are not necessarily separated but could be included in a single block.

Figure 2:
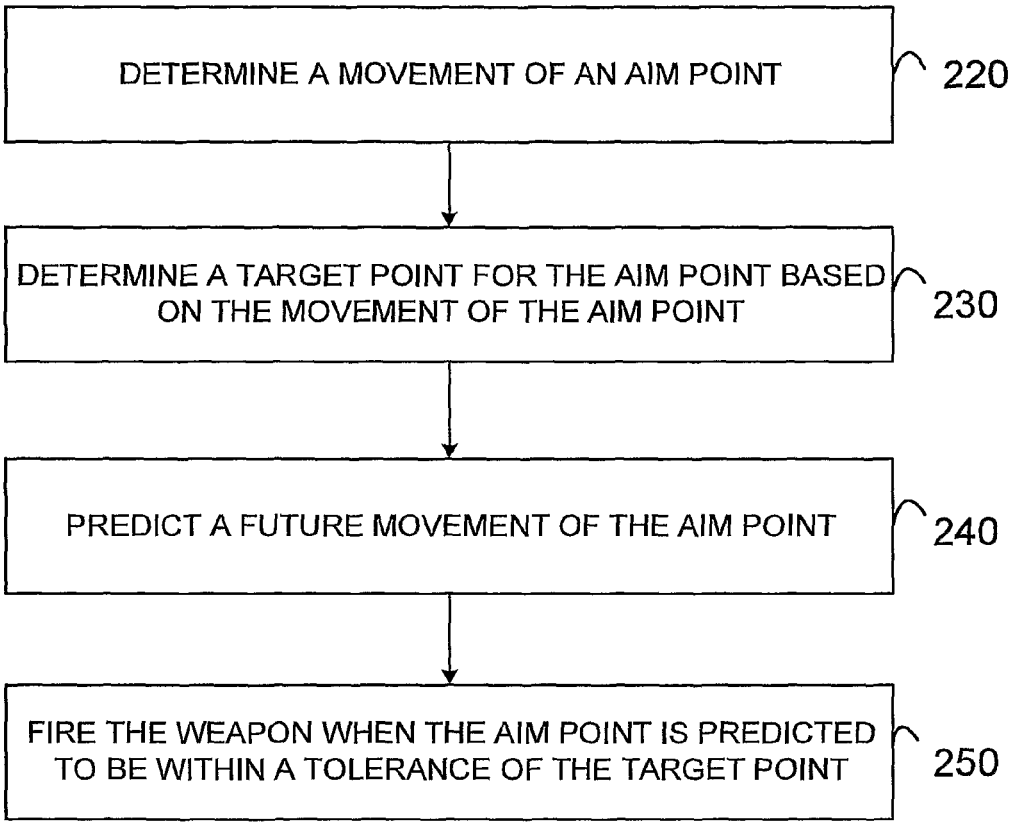
FIG. 2 illustrates a method according to an exemplary embodiment of the present invention.

Referring to FIG. 2, there is illustrated a flowchart of a method describing the steps in a fire arm 20 for firing the fire arm 20 in accordance with previously described embodiments of the present invention. As shown in FIG. 2, the method comprises the steps of:

Step 220: determining a movement of an aim point 22 for the fire arm 20 relative to a target 50.

Step 230: determining a target point 21 for the aim point 22 based on the movement of the aim point 22;

Step 240: predicting a future movement of the aim point 22 based on the movement of the aim point 22;

Step 250: firing the fire arm 20 when the aim point 22 is predicted to be within a tolerance of the target point 21.

While the present invention has been described with respect to particular embodiments (including certain device arrangements and certain orders of steps within various methods), those skilled in the art will recognize that the present invention is not limited to the specific embodiments described and illustrated herein. Therefore, it is to be understood that this disclosure is only illustrative. Accordingly, it is intended that the invention be limited only by the scope of the claims appended hereto.

The invention claimed is:

1. An arrangement for firing a firearm, said arrangement comprising:

a determining unit comprising a camera which captures consecutive images of said target, wherein said determining unit is configured to determine a movement of an aim point for said firearm relative to a target by using image processing of said consecutive images;

a processing unit configured to determining a target point for said aim point from said movement of said aim point, and to predict a future movement of said aim point based on said movement of said aim point, wherein a dynamic model of said firearm is used in determination of at least the future movement of said aim point, and wherein the dynamic model comprises weight and size of at least one of a shooter or a weapon platform to compensate for at least one of shaking or swaying from at least one of the shooter or the weapon to increase accuracy; and a firing unit configured to fire said firearm when said aim point is predicted to be within a tolerance of said target point.

2. The arrangement according to claim 1, wherein the camera is incorporated in a telescopic sight of said firearm.

3. The arrangement according to claim 1, wherein the camera is attached to a telescopic sight of said firearm.

4. The arrangement according to claim 1, wherein said determining unit comprises at least one accelerometer, and wherein said determining unit is further configured to determine said movement of said aim point by using signals from said at least one accelerometer.

5. The arrangement according to claim 1, wherein said processing unit is further configured to wait until said target point is within a tolerance before starting to predict a future movement of said aim point based on said movement of said aim point.

6. The arrangement according to claim 1, wherein said arrangement is configured for detachable connection to said firearm.

7. A method in a firearm for firing the arm firearm, the method comprising:

determining a movement of an aim point for said firearm relative to a target using a camera which captures consecutive images of said target, wherein said movement of said aim point is determined by using image processing of said consecutive images;

determining a target point for said aim point from said movement of said aim point;

predicting a future movement of said aim point based on said movement of said aim point, wherein a dynamic model of said firearm is used in determination of at least the future movement of said aim point, and wherein the dynamic model comprises weight and size of at least one of a shooter or a weapon platform to compensate for at least one of shaking or swaying from at least one of the shooter or the weapon to increase accuracy; and firing said firearm when said aim point is predicted to be within a tolerance of said target point.

8. The method according to claim 7, wherein in said determining a movement of said aim point, said movement is determined using at least one accelerometer, and wherein said determining a movement of said aim point further comprises determining said movement of said aim point using signals from said at least one accelerometer.

9. The method according to claim 7, wherein in said predicting a future movement of said aim point said future movement of said aim point is predicted after said target point is within a tolerance.

* * * * *